US005376521A

United States Patent [19]

Inoue et al.

[11] Patent Number: 5,376,521

[45] Date of Patent: Dec. 27, 1994

[54] SILVER HALIDE PHOTOGRAPHIC LIGHT-SENSITIVE MATERIAL AND A METHOD FOR PROCESSING THE SAME

[75] Inventors: Kenichi Inoue; Takuji Hasegawa; Yuji Hosoi; Yorihiro Yamaya; Akiko Suzuki, all of Hino, Japan

[73] Assignee: Konica Corporation, Japan

[21] Appl. No.: 141,111

[22] Filed: Oct. 21, 1993

[30] Foreign Application Priority Data

Oct. 27, 1992 [JP] Japan ..... 4-289002

[51] Int. Cl.[5] ..... G03C 1/015

[52] U.S. Cl. ..... 430/567; 430/568; 430/569

[58] Field of Search ..... 430/567, 568, 569

[56] References Cited

U.S. PATENT DOCUMENTS 4,414,304 11/1983 Dickerson ..... 430/567

5,273,871 12/1993 Takada et al. ..... 430/567

*Primary Examiner*—Janet C. Baxter

*Attorney, Agent, or Firm*—Jordan B. Bierman

[57] ABSTRACT

A silver halide photographic light-sensitive material comprising a support bearing on both sides thereof a silver halide emulsion layer containing a silver halide emulsion comprising monodispersed and spectrally-sensitized silver halide tabular grains having an average aspect ratio of grain diameter to grain thickness of from not less than 2 to less than 8 and accounting for at least 70% of the total projected area of the grains contained in the silver halide emulsion and a method of preparing the silver halide emulsion are disclosed, wherein the silver halide emulsion is chemically sensitized in the presence of iodide-containing silver halide fine grains, thus chemically-sensitized emulsion having a value of 100 mV or less with respect to a silver electrode potential at 50° C.

7 Claims, No Drawings

SILVER HALIDE PHOTOGRAPHIC LIGHT-SENSITIVE MATERIAL AND A METHOD FOR PROCESSING THE SAME

FIELD OF THE INVENTION

This invention relates to a silver halide photographic light-sensitive material and, particularly, to a silver halide photographic light-sensitive material having low fog and high sensitivity and to a method for processing the same.

BACKGROUND OF THE INVENTION

In a silver halide photographic light-sensitive material, the adsorption amount of a spectrally sensitizing dye relates to the iodide composition of the silver halide grain surface. Generally, the adsorption amount is reduced when an iodine content is small.

When the adsorbability of a dye is unsatisfactory, not only a spectral sensitizability cannot be excellent, but also a cross-over light is increased in an X-ray light-sensitive material, so that an image sharpness is resultingly deteriorated.

Therefore, with the purpose of increasing the adsorption amount of a sensitizing dye, it has been carried out the introduction of the iodide into a silver halide grain surface. However, when increasing a silver iodide content of a grain, the following problems are raised accordingly. When an aqueous potassium iodide solution is added to an emulsion so as to produce a halide-conversion and a dye is then added thereto, the adsorption amount of a dye is increased, however, on the other hand, the inherent sensitivity of the emulsion is lowered and it cannot therefore be said that the resulting sensitizability is satisfactory.

For the purpose of eliminating the reduction of the above-mentioned inherent sensitivity, for example, Japanese Patent Publication Open to Public Inspection (hereinafter referred to as JP OPI Publication) No. 3-213845/1991 discloses a method for adding a fine-grained silver halide so as to produce a recrystalization. This method, however, has such a defect that a desensitization is produced in preparing a coating solution or in storing a film.

For the purpose of enhancing a dye adsorbability, for example, JP OPI Publication No. 55-26589/1980 discloses a method for adding a dye in the course of carrying out a chemical ripening treatment. In this method, however, a chemical sensitization is hard to be sufficiently performed, because the surface of a grain is covered by a dye, so that any sensitivity increase cannot be obtained.

In view of the above-mentioned situation, any other new countermeasure has been demanded.

SUMMARY OF THE INVENTION

It is, therefore, an object of the invention to provide a silver halide photographic light-sensitive material in which the inherent sensitivity of an emulsion is not lowered and a spectral sensitization is highly applied with a satisfactory amount of a dye.

Another object of the invention is to provide a silver halide photographic light-sensitive material having an excellent standing stability of a coating solution and no sensitivity lowering in storing a raw film or no desilvering deterioration in the course of carrying out a process, and to provide a method for processing the light-sensitive material.

Other objects of the invention will become apparent from the following detailed description.

The above-mentioned objects of the invention can be achieved with (1) a silver halide photographic light-sensitive material comprising a support bearing on the both sides thereof a silver halide emulsion layer containing spectrally sensitized and monodispersed tabular-shaped grains having an average aspect ratio within the range from not less than 2 to less than 8 of and accounting for not less than 70% of the whole projected area; wherein the surface of the grain is AgI-converted by a fine grained silver halide in the course of chemically sensitizing the silver halide emulsion and the silver electrode potential of the emulsion is not higher than 100 mv at a temperature of 50° C., and (2) A method for processing a silver halide photographic light-sensitive material comprising processing the light-sensitive material claimed in claim 1 with a developer substantially not containing a hardener, which is replenished in an amount of not more than 25 ml per sheet of 10″×12″ film.

DETAILED DESCRIPTION OF THE INVENTION

In the invention, the proportion occupied by a monodisperse type tabular-shaped grain having an aspect ratio within the range of not less than 2 to less than 8 is preferably at least not less than 70% of the whole projected area of silver halide grains and more preferably not less than 90% thereof. The aspect ratio used herein is the ratio of silver halide grain diameter to thickness.

The term, "monodisperse", stated herein is as defined in JP OPI Publication No. 60-162244/1985 and the variation coefficient of grain size distribution is preferably within the range of 5 to 25%.

As for the halogen composition of a tabular-shaped grain, silver iodobromide and silver chloroiodobromide are preferably used. A silver iodobromide emulsion contain preferably silver iodide content of not more than 3 mol % more preferably, not less than 0.5 mol % to not more than 3 mol %.

In the silver halide emulsions relating to the invention, the tabular-shaped grain thereof is to have a projective area-equivalent diameter within the range of 1.5 μm to 0.4 μm and, preferably 1.0 μm to 0.7 μm. The projective area diameter is defined as a diameter of a circle having an area equivalent to the projective area of the grain. The aspect ratio of the tabular-shaped grain may be within the range of not lower than 2 to lower than 8 and, preferably not lower than 2 to not higher than 5.

As for the processes for preparing tabular-shaped silver halide grains, any processes well-known in the art may be used suitably in combination. For example, the grains can be prepared in such a process as described in JP OPI Publication No. 55-142329/1980, 61-6643/1986 or 63-163451/1988.

In the invention, it is preferable that not less than 70% (by number) of the whole grains are occupied by hexagonal tabular-shaped grains.

In the tabular-shaped silver halide grains relating to the invention, the surfaces of the grains are subjected to an AgI-conversion by fine-grained silver halide in the course of carrying out a chemical sensitization.

The term, "AgI-conversion" stated herein means that a high iodide-containing phase is formed on the surface of the grains by making use of fine grains containing silver iodide content of not less than 80 mol %. Thus, the iodide-containing fine grains dissolve and recrystalize to form high-iodide silver halide phase on the grain surface. The grain size of a fine grained silver halide is to be not larger than 0.15 μm, preferably not larger than 0.1 μm and particularly not larger than 0.01 μm, each in terms of an average grain size converted into a sphere.

As for the silver halide composition, silver iodobromide is preferably used. Among them, a silver iodobromide emulsion containing silver iodide content of not less than 80 mol % and particularly not less than 90 mol % is preferably used. Such an emulsion as mentioned above can be prepared in any ordinary process.

The term, "a chemical sensitization" stated in this invention herein means either one of a sulfur sensitization, a gold-sulfur sensitization, a reduction sensitization and so forth. It is also allowed to use a chemical-ripening agent disclosed in Research Disclosure (hereinafter sometimes abbreviated to RD) that will be mentioned later.

A spectral sensitizing dye is preferable to be added before adding the above-mentioned ripening agent.

The expression, "in the course of carrying out a chemical sensitization" stated in this invention means a period of time from the point of time when starting a chemical ripening treatment upon adding a ripening agent to the point of time when the chemical ripening treatment is completed with an ordinary method of lowering a potential, lowering a temperature or adding an inhibitor.

It is particularly preferable to add a fine grain silver halide emulsion relating to the invention within a period from 10 minutes after adding the ripening agent to 30 minutes before completing chemical ripening treatment.

Silver ion concentrations in the emulsion can be determined with an indicating electrode of pure silver, the potential of which is expressed versus the silver/silver chloride electrode as reference. After chemical sensitizing an emulsion of the invention, the emulsion have the silver electrode potential of not higher than 100 mv at a temperature of 50° C., preferably 90 mv and more preferably, not higher than 80mv. When the silver electrode potential, prior to the chemical sensitization, is set to be not higher than 100 mv, preferably 50 to 75 mv, fog-increase after coating is prevented and the sensitivity can also be stabilized. The silver electrode potential is preferably controlled by making use of potassium bromide. The point of time when the above-mentioned silver electrode potential is preferably controlled after completing a chemical ripening treatment.

A tabular-shaped silver halide emulsion relating to the invention may be spectrally sensitized in an ordinary method. The spectral sensitizing methods include any well-known methods in which any spectral sensitizing dye well-known in the art is used. It is preferable to use two or more kinds of cyanine dyes in combination.

The above-mentioned silver halide photographic light-sensitive material of the invention is processed with developer not substantially containing a hardener and at same time, it is processed by replenishing the developer in an amount of not more than 25 ml per sheet of 10"×12" film.

Heretofore in a high-temperature and rapid processing, a hardener such as glutar aldehyde has been used in a developer. This process has an advantage to provide gelatin with such a physical property as capable to resist against a high temperature of not lower than 35° C. and a rapid film transport through an automatic processor. However, it is undeniable that a development speed is reduced not a little and that a sensitivity and the maximum density are each deteriorated. On the other hand, the market demands for the environmental protection have been increased and the smell of glutar aldehyde contained in a developer has been disliked, because the smell gives people a discomfort.

Therefore, when a light-sensitive material is provided to itself with a suitable hardening property, a layer is not substantially needed to be hardened by a developer and, resultingly, a developability can be prevented from deterioration.

In the invention, a film is processed with a developer not containing any layer hardener and the developer is replenished in an amount of not more than 25 ml per sheet of 10"×12" film, it is possible to obtain a silver halide photographic light-sensitive material having the photographic characteristics which are the objects of the invention.

The developer mentioned herein may also have the same composition as those of the developers ordinarily used. In the invention, the replenishing amount may be not more than 25 ml and, preferably within the range of 20 ml to 10 ml per sheet of 10"×12" film.

The silver halide emulsions relating to the invention may be treated in a noodle-washing method, a flocculation precipitation method or the like so that a soluble salt may be removed. The preferable washing methods include, for example, a method in which an aromatic hydrocarbon type aldehyde resin containing a sulfo group is used as described in Japanese Patent Examined Publication (hereinafter referred to as Examined Publication) No. 35-16086/1960 or a desalting method in which a macromolecular flocculant such as exemplified compounds G-3 and G-8 given in JP OPI Publication No. 63-158644/1988.

In the emulsions applicable to a silver halide photographic light-sensitive material of the invention, a variety of photographic additives may be used in a processing step before or after carrying out a physical or chemical ripening treatment.

The compounds applicable to such a processing step as mentioned above include, for example, various kinds of compounds such as those given in Research Disclosure (RD) Nos. 7643, 18716 and 308119 (December, 1989). The compounds described in the above three (RD)s will be given below by classifying them into the kinds thereof and the pages described thereof.

| | RD-17643 | | RD-18716 | RD-308119 | |
|---|---|---|---|---|---|
| Additive | Page | Class | Page | Page | Class |
| Chemical sensitizer | 23 | III | 648 u-r | 996 | III |
| Sensitizing dye | 23 | IV | 648~649 | 996~8 | IV |
| Desensitizing dye | 23 | IV | | 998 | B |
| Dye stuff | 25~26 | VIII | 649-650 | 1003 | VIII |
| Development accelerator | 29 | XXI | 648 u-r | | |
| Antifoggant. stabilizer | 24 | IV | 649 u-r | 1006~7 | VI |
| Whitening agent | 24 | V | | 998 | V |
| Hardener | 26 | X | 651 r. | 1004~5 | X |
| Surfactant | 26~27 | XI | 650 r. | 1005~6 | XI |
| Plasticizer | 27 | XII | 650 r. | 1006 | XII |
| Lubricant | 27 | XII | | | |

-continued

| Additive | RD-17643 Page | RD-17643 Class | RD-18716 Page | RD-308119 Page | RD-308119 Class |
|---|---|---|---|---|---|
| Matting agent | 28 | XVI | 650 r. | 1008~9 | XVI |
| Binder | 26 | XXII | | 1003~4 | IX |
| Support | 28 | XVII | | 1009 | XVII |

The supports applicable to the silver halide photographic light-sensitive materials of the invention include, for example, those described in the above-given RDs. Among them, a plastic film-made supports and so forth are suitable and the surfaces thereof may be provided with a sublayer or may also be corona-discharged or UV-irradiated so as to improve the adhesive property to coated layers.

The light-sensitive materials of the invention may be processed, for example, with such a developer as described in the foregoing RD-17643, XX~XXI, pp.29~30 or RD-308119, XX~XXI, pp.1011~1012. These processes also include a black-and-white photographic process in which a silver image may formed. The processes are usually carried out at a temperature within the range of 18° C. to 50° C.

The developers applicable to the black-and-white photographic process include, for example, a dihydroxyoenzene (such as hydroquinone), a 3-pyrazolidone (such as 1-phenyl-3-pyrazolidone) and an aminophenol (such as N-methyl-p-aminophenol), and they may be used independently or in combination. If required, such a developer as mentioned above may also be used with the following well-known additives such as a preservative, an alkalizer, a pH buffer, an antifoggant, a development accelerator, a surfactant, a defoamer, a color toner, a hard-water softener, a dissolving aid and a tackifier.

In a fixer, such a fixing agent as a thiosulfate and thiocyanate may be used. The fixer is also allowed to contain layer hardeners including a water-soluble aluminjure salt such as aluminium sulfate and potassium alum. Besides the above, the fixer is further allowed to contain, for example, a preservative, a pH controller and a hard-water softener.

In the present invention, an overall processing time refers to the period of time through which the photographic material of the present invention is inserted to the first roller, which constitute the inlet of an automatic processing machine, and thereafter it passes through a developing tank, a fixing tank, and a drying tank until it reaches the last roller at a drying section outlet.

The overall processing time is 50 seconds or less, and preferably from 20 to 50 seconds. A processing time of less than 20 seconds may give rise to insufficient sensitivity, or bring about a dye residue or an image poor in uniformity.

The processing is carried out at a temperature of 60° C. or less, and preferably from 20° to 45° C.

EXAMPLES

Now, the invention will be detailed with reference to the examples thereof. However, the invention shall not be limited to the examples described below.

EXAMPLE 1

(Preparation of a seed emulsion)

A high monodisperse type seed emulsion EM-0 was prepared in the following procedures.

| | | |
|---|---|---|
| A1 | Hydrogen peroxide-treated ossein gelatin | 11.3 g |
| | Potassium bromide | 6.72 g |
| | Add water to make | 1.13 l |
| | B1 Silver nitrate | 170 g |
| | Add water to make | 227.5 ml |
| C1 | Ossein gelatin | 4.56 g |
| | Potassium bromide | 119 g |
| | Add water to make | 227.5 ml |
| D1 | Aqueous ammonia (28%) | 66.6 ml |

Solutions B1 and C1 were added, in a double-jet method, into solution A1 which was violently stirred at 40° C., so that nuclei were produced. After the addition was completed, the temperature of the resulting mixed solution was lowered to 20° C. and the potential was adjusted to be 40 mv. Then, solution D1 was added thereto by taking 20 seconds and the mixed solution was ripened for 5 minutes.

The pH of the ripened solution was adjusted to be 6.0 by making use of acetic acid. The solution was precipitated and desalted by making use of an aqueous solution of Demol manufactured by Kao-Atlas Co. and an aqueous solution of magnesium sulfate, and was then washed with water. The resulting emulsion was redispersed by making use of 23 g of ossein gelatin, so that a seed emulsion was prepared.

When the seed emulsion was observed through an electron microscope, it was proved to be a monodisperse type AgBr emulsion having an average grain size of 0.28 μm and a distribution range of 30%.

(Preparation of tabular-shaped grains)

By making use of the above-mentioned seed emulsion EM-0 and the following solutions, silver halide emulsion EM-1 mainly comprising tabular-shaped twinned crystals was prepared.

| | | |
|---|---|---|
| E1 | Ossein gelatin | 6.49 g |
| | Disodium polypropyleneoxy-polyethyleneoxy-disuccinate (in a 10% methanol solution) | 1.1 ml |
| | The seed emulsion, in an amount equivalent to | 0.62 mols |
| F1 | Ossein gelatin | 1.69 g |
| | Potassium bromide | 107.2 g |
| | Potassium iodide | 2.30 g |
| | Add water to make | 504 ml |
| G1 | Silver nitrate | 170 g |
| | Add water to make | 504 ml |

Solutions F1 and G1 were added, in a controlled double-jet method, into the above-given F1 solution which was violently stirred at 65° C. At that time, the flow rate of the addition was so controlled as to be 80% of the flow rate at which new nuclei were produced. In the course of the addition, the potential was so maintained as to be −10 mv at 65° C., by making use of an aqueous KBr potential-controller solution.

After completing the above-mentioned addition, the pH of the resulting mixed solution was adjusted to be 6.0 and, sodium 5,5'-dichloro-9-ethyl-3,3'-di-(3-sulfopropyl) oxacarbocyanine anhydride (hereinafter referred to as sensitizing dye A) was added in an amount of 283 mg per mol of silver halide so as to serve as a spectrally sensitizing dye. After making an adsorption completely, the resulting matter was desalted in the same manner as in the case of the seed emulsion preparation.

The resulting emulsion was proved to have a potential of 50 mv and pH of 5.85, each at 50° C.

Approximately 3,000 grains of EM-1 were observed and measured through an electron microscope and the configuration of the grains were analyzed. The results thereof were as follows.

The percentage of the hexagonal tabular-shaped crystals occupied in the whole projected area: 80%

The average grain size (converted into spheres) of the hexagonal tabular-shaped crystals: 0.85 μm The average grain thickness of the hexagonal tabular-shaped crystals: 0.32 μm The average aspect ratio of the hexagonal tabular-shaped crystals: 2.7

The monodispersion degrees of the hexagonal tabular-shaped crystals: 20%

(Preparation of regular crystal grains)

A monodisperse type cubic-crystal silver iodobromide emulsion having an average grain size of 0.3 μm and containing silver iodide in a proportion of 2 mol % was prepared in a controlled double-jet method and while keeping a reaction chamber under the conditions of 60° C., pAg of 8 and pH of 2. The twinned crystal production ratio was proved to be not higher than 1% in number, when observing the emulsion through an electron microscope.

The resulting emulsion was used as seed crystals and was then further grown up as follows. An aqueous gelatin solution was put into a reaction chamber and then kept at 40° C. The above-mentioned seed crystals were dispersed and the pH thereof was controlled to be 9.5 by adding aqueous ammonia and acetic acid. Next, pAg was controlled to be 7.3 by making use of an ammoniacal silver ion solution and, while keeping the pH and pAg constant, a solution containing ammoniacal silver ion, potassium iodide and potassium bromide was added thereto in a controlled double-jet method, so that a silver iodobromide layer containing silver iodide of 30 mol % was formed.

By making use of acetic acid and silver bromide, pH and pAg were adjusted to be 9 and 9.0, respectively. Then, an ammoniacal silver ion solution and potassium bromide were added thereto at the same time, so as to grow up to be 90% of the size of the finally grown up grains.

At that time, the pH was gradually lowered from 9.0 to 8.2.

A potassium bromide solution was added to make pAg to be 11 and, then, an ammoniacal silver ion solution and potassium bromide were further added to grow up the grains while lowering the pH down to 8.0, so that a silver iodobromide emulsion having an average grain size of 1.23 μm and containing silver iodide of 2 mol % was prepared. When preparing the emulsion, the foregoing sensitizing dye (A) was further added in an amount of 200 mg per mol of the silver content of the emulsion.

For removing excess salts, the following desalting treatment was carried out.

While keeping the silver halide emulsion at 40° C., the silver halide grains were precipitated by adding a sodium naphthalenesulfonate-formaldehyde condensate. After removing the supernatant, pure water kept at 40° C. was further Successively, magnesium sulfate was added and the silver halide grains were precipitated again and the supernatant was removed. The same procedures were repeated once more and gelatin was then added, so that an emulsion having a pH of 6.0 and a pAg of 8.5 was obtained. The resulting emulsion is hereinafter referred to as Em-A.

The amount of the seed emulsion was further controlled, so that Em-B having an average grain size of 0.4 μm was prepared in the same procedures as in the case of Em-A.

Immediately before adding hypo and a chemical sensitizer comprising chloroauric acid to each of the resulting emulsions, the emulsions were added respectively by the foregoing spectral sensitizing dye (A) in an amount of 150 mg and sensitizing dye (B), that was sodium 5,5'-di-(butoxy carbonyl)-1,1'-diethyl-3,3'-di-(4-sulfobutyl) benzimidazolo carbocyanine anhydride in an amount of 15 mg per mol of the silver halide content. After the emulsions were each chemically ripened, 4-hydroxy-6-methyl-1,3,3a, 7-tetrazaindene as a stabilizer was added in an mount of 2.5 g per mol of the silver halide content.

(Chemical sensitization of tabular-shaped emulsion EM-1)

Immediately before adding a chemical sensitizer comprising 1% $NH_4SCN$ in an amount of 5.2 ml, 0.2% $HAuCl_4$ in an amount of 0.78 ml and 0.25% $Na_2S_2O_3$ in an amount of 5.6 ml, each per mol of the silver content, the foregoing spectral sensitizing dye (A) of 127 mg and spectral sensitizing dye (B) of 1.3 mg were added to EM-1. The resulting emulsion was chemically sensitized at 48° C.

After starting the chemical sensitization, the additives shown in Table 1 were added by taking 30 minutes respectively in the amounts per mol of the silver halide contents, as shown in Table 1. After a chemical ripening treatment was further continued for 20 minutes, 4-hydroxy-6-methyl-1,3,3a,7-tetrazaindene was added in an amount of 2.4 g per mol of the silver halide content. After that, the temperature was lowered so as to stop the chemical ripening treatment in reaction.

TABLE 1

| Emulsion | Additive | Amount added (in mol) |
|---|---|---|
| EM-1-1 | KI | 0.002 |
| EM-1-2 | KI | 0.003 |
| EM-1-3 | AgI grains* | 0.0005 |
| EM-1-4 | AgI grains* | 0.001 |
| EM-1-5 | AgI grains* | 0.002 |
| EM-1-6 | AgI grains* | 0.003 |

*AgI grains were AgI fine grains each having an average grain size of 0.04 μm.

The above-mentioned chemically ripened emulsions were mixed up respectively as shown in Table 2. After that, the following various additives were each added, so that the coating solutions were prepared, respectively. The potentials of the coating solutions were each controlled by adding an aqueous KBr solution to the coating solutions. The amounts of the additives added thereto will be shown in the amounts per mol of the silver halide contents, respectively.

TABLE 2

| Coating solution No. | Emulsions mixed | | | Potential of coating solution | Remarks |
|---|---|---|---|---|---|
| 1 | EM-1-1 72% | Em-A 20% | Em-B 8% | 100 (mV) | Comparison |
| 2 | EM-1-2 72% | Em-A 20% | Em-B 8% | 90 | Comparison |
| 3 | EM-1-3 72% | Em-A 20% | Em-B 8% | 90 | Invention |
| 4 | EM-1-4 72% | Em-A 20% | Em-B 8% | 90 | Invention |
| 5 | EM-1-5 72% | Em-A 20% | Em-B 8% | 90 | Invention |
| 6 | EM-1-6 72% | Em-A 20% | Em-B 8% | 90 | Invention |
| 7 | EM-1-5 72% | Em-A 20% | Em-B 8% | 100 | Invention |
| 8 | EM-1-5 72% | Em-A 20% | Em-B 8% | 80 | Invention |
| 9 | EM-1-5 72% | Em-A 20% | Em-B 8% | 110 | Comparison |
| 10 | EM-1-5 72% | Em-A 20% | Em-B 8% | 130 | Comparison |

| | |
|---|---|
| 1-phenyl-5-mercaptotetrazole | 10 mg |
| 1-trimethylol propane | 14 g |
| t-butyl-catechol | 68 mg |
| Polyvinyl pyrrolidone (having a molecular weight of 10,000) | 850 mg |
| A styrene-maleic anhydride copolymer | 2.0 g |
| Nitrophenyl-triphenyl phosphonium chloride | 50 mg |
| Ammonium 1,3-dihydroxybenzene-4-sulfonate | 1.7 g |
| 1,1-dimethylol-1-bromo-1-nitromethane | 6.2 mg |
| $nC_4H_9OCH_2CH(OH)CH_2N(CH_2COOH)_2$ | 700 mg |
| 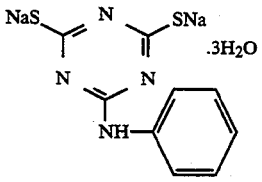 | 42 mg |
| 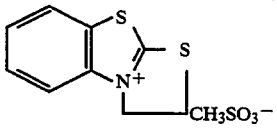 | 28 mg |
| 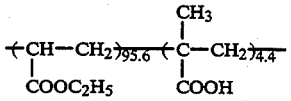 | 18 mg |

The additives applied to a protective layer solution were as follows. The amounts thereof added will be indicated by an amount per gram of gelatin used.

| | |
|---|---|
| A matting agent comprising polymethyl methacrylate having an average particle size of 5 μm | 21 mg |
| A matting agent comprising polymethyl methacrylate having an average particle size of 3 μm | 28 mg |
| Glyoxal | 50 mg |
| 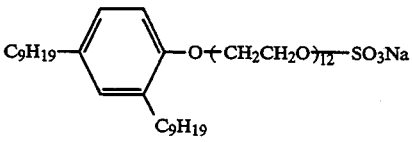 | 20 mg |
| 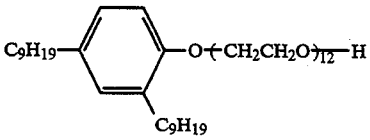 | 7 mg |
| $NaO_3S-CH(CH_2COOCH_2CH(CH_3)_2)COOCH_2CH_2COOCH_2CH_2CH_3$ | 7 mg |
| $C_{12}H_{25}CONH(CH_2CH_2O)_5H$ | 62 mg |

-continued

| | |
|---|---|
| 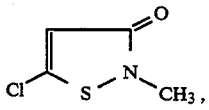 | 0.9 mg |
| 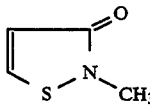 | |
| 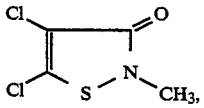 | |
| (50:46:4) | |

The resulting coating solutions were uniformly coated respectively on both sides of a 180 μm-thick subbed blue-colored polyethylene terephthalate film base and were then dried, so that the respective samples were prepared.

On one side of every sample, the coating weights of silver and gelatin were so controlled to be 2.0 g/m$^2$ and 3.5 g/m$^2$, respectively.

For the purpose of testing the coating solution stability, after each coating solution was allowed to stand at 35° C. for 10 hours after it was prepared, it was coated on a film base in the same manner as mentioned above and was then allowed to stand for another 10 hours, so that the test samples were prepared.

Evaluation of sensitivity

The resulting samples were each sandwiched between X-ray intensifying screens KO-250 (manufactured by Konica Corp.) and exposed to X-rays through a penetrometer Type B. After that, they were each developed through an automatic processor under the following conditions.

The compositions of the developer and fixer used in the invention were as follows.

| Developer | |
|---|---|
| Part-A (for making 10.8 liters) | |
| Potassium hydroxide | 340 g |
| Potassium sulfite (in a 50% solution) | 2,150 g |
| Diethylene tetramine pentaacetic acid | 32.3 g |
| Sodium hydrogencarbonate | 108 g |
| 5-methyl benzotriazole | 150 mg |
| 1-phenyl-5-mercaptotetrazole | 15 mg |
| Hydroquinone | 280 g |
| Add water to make | 3,600 ml |
| Part-B (for making 10.8 liters) | |
| Glacial acetic acid | 158 g |
| Triethylene glycol | 144 g |
| 1-phenyl-3-pyrazolidone | 19.5 g |
| 5-nitroindazole | 0.32 g |
| n-acetyl-D,L-penicillamine | 0.11 g |
| Starter (for making 1.0 liter) | |
| Glacial acetic acid | 138 g |
| Potassium bromide | 325 g |
| 5-methyl benzotriazole | 1.5 g |
| $CH_3N(C_3H_6NHCONHC_2H_4SC_2H_5)_2$ | 20 mg |
| Add water to make | 1.0 l |

Starter was added in an amount of 20 ml per liter of the developer.

| Fixer | |
|---|---|
| Part-A (for making 16.4 liters) | |
| Ammonium thiosulfate (at 70 wt/vol %) | 3,460 g |
| Sodium sulfite | 150 g |
| Sodium acetate.trihydrate | 350 g |
| Sodium citrate | 43 g |
| gluconic acid | 33 g |
| Boric acid | 26 g |
| Glacial acetic acid | 120 g |
| Part-B (for making 16.4 liters) | |
| Aluminum sulfate | 56 g |
| Sulfuric acid (at 50 wt %) | 91 g |

| Processing step | | | |
|---|---|---|---|
| Step | Temp. (°C.) | Time(sec) | Amt. replenished |
| Inserting | — | 1.2 | |
| Dev. + cross-over | 35 | 14.6 | 270 ml/m$^2$ |
| Fix. + cross-over | 33 | 8.2 | 430 ml/m$^2$ |
| Wash. + cross-over | 18 | 7.2 | 7.0 l/min. |
| Squeezing | 40 | 5.7 | |
| Drying | 50 | 8.1 | |
| Total | — | 45.0 | |

In the automatic processor, the capacities of the developer tank, fixer tank and washing tank were 16 liters, 10 liters and 10 liters, respectively. Clinker 205 (manufactured & distributed by Nippan Labs, Ltd. and mainly comprised of $SiO_2$, $Al_2O_3$, Ag+ion ceramics having a particle size of 1.0~1.5 mm and a specific gravity of 2.5~2.6) of 200 g was filled up in a bag made of a 20-mesh polyethylene-fiber and was then dipped in around the washing water-supplying section of the washing tank. In the drying step, an infrared heater (for heating at 220° C.) and warm wind (at 60° C.) were used in combination.

The insertion of films were detected by making use of an infrared sensor. Thereby, the area of 10 sheets of 10"×12" sized film was detected and then the amount of replenisher for 10 sheets of 10"×12" film (or 210 ml of developer and 320 ml of fixer) was replenished.

Of the resulting developed samples, the sensitivities thereof were evaluated. The sensitivity of each sample was indicated by a value relative to the sensitivity obtained immediately after coating solution No. 5 was prepared and regarded as a value of 100. The sensitivity of each sample was obtained from the reciprocal of an exposed energy required for providing a density of fog+1.0. The results thereof will be shown in the following Table 3.

TABLE 3

| Coating solution No. | Fog | Sensitivity (obtained just after preparing solution) | Sensitivity (obtained after 10-hr. standing solution) | Remarks |
|---|---|---|---|---|
| 1 | 0.04 | 60 | 60 | Comparison |
| 2 | 0.04 | 40 | 40 | Comparison |
| 3 | 0.04 | 80 | 79 | Invention |
| 4 | 0.04 | 90 | 88 | Invention |
| 5 | 0.04 | 100 | 98 | Invention |
| 6 | 0.04 | 110 | 108 | Invention |
| 7 | 0.04 | 100 | 96 | Invention |
| 8 | 0.04 | 96 | 96 | Invention |
| 9 | 0.04 | 100 | 80 | Comparison |
| 10 | 0.04 | 100 | 70 | Comparison |

As is obvious from the table, the samples of the invention were proved to be stable in coating solution digestion and were also capable of maintaining a high sensitivity as compared to the comparative samples.

EXAMPLE 2

When the samples prepared in Example 1 were each processed in the same manner as in Example 1, except that a glutaraldehyde layer hardener, was added into a developer, residual silver was liable to be produced during fixing of the samples.

What is claimed is:

1. A silver halide photographic light-sensitive material comprising a support bearing on both sides thereof a silver halide emulsion layer containing a silver halide emulsion comprising monodispersed and spectrally-sensitized silver halide tabular grains having an average aspect ratio of grain diameter to grain thickness of from not less than 2 to less than 8 and accounting for at least 70% of the total projected area of the grains contained in the silver halide emulsion, wherein said silver halide emulsion is chemically sensitized in the presence of iodide-containing silver halide fine grains, the chemically sensitized emulsion having a silver potential of 100 mV or less at 50° C.

2. The silver halide photographic material of claim 1, wherein said silver halide tabular grains comprise silver iodobromide having a silver iodide content of not more than 3 mol %.

3. The silver halide photographic material of claim 1, wherein said aspect ratio is from 2 to 5.

4. The silver halide photographic material of claim 1, wherein said fine grains are silver iodide fine grains.

5. A method of preparing a silver halide emulsion comprising silver halide tabular grains having an aspect ratio of grain diameter to thickness of not less than 2 to less than 8 and accounting for at least 70% of the total projected area of the grains contained in the emulsion comprising forming said silver halide tabular grains by mixing a silver salt solution and a halide solution and carrying out chemical sensitization of said grains formed, wherein silver halide fine grains containing silver iodide are added at a time during the course of chemical sensitization; and after completing the chemical sensitization, said emulsion is adjusted to have a silver electrode potential of 100 mV or less at 50° C.

6. The method of claim 5, wherein said silver halide fine grains are added at a time within a period from 10 minutes after adding a chemical-ripening agent to 30 minutes before completing chemical sensitization.

7. The method of claim 6, wherein a spectral sensitizing dye is added prior to addition of the chemical-ripening agent.

* * * * *